United States Patent [19]

Brown, Jr.

[11] Patent Number: 4,827,105

[45] Date of Patent: May 2, 1989

[54] HAND HELD HAIR DRYER

[76] Inventor: Foster L. Brown, Jr., 354 E. 77th St., Chicago, Ill. 60619

[21] Appl. No.: 59,160

[22] Filed: Jun. 3, 1987

Related U.S. Application Data

[63] Continuation-in-part of Ser. No. 714,169, Mar. 20, 1985.

[51] Int. Cl.[4] ..... F24H 3/00; H05B 1/00

[52] U.S. Cl. ..... 219/373; 219/370

[58] Field of Search ..... 219/370, 373, 369, 364; 132/9, 11 A, 11 R, 112-116; 34/96-101

[56] References Cited

U.S. PATENT DOCUMENTS

| | | | |
|---|---|---|---|
| 1,777,744 | 10/1930 | Breuer | 219/373 |
| 1,839,119 | 12/1931 | Potter | 219/370 X |
| 2,478,559 | 8/1949 | Bergeron | 219/373 X |
| 3,386,185 | 6/1968 | Angelillo | 132/112 X |
| 3,696,818 | 10/1972 | Weber | 132/9 |
| 3,835,869 | 9/1974 | Newman et al. | 132/9 |
| 3,861,060 | 1/1975 | McNair | 34/97 |
| 3,903,905 | 9/1975 | Tucker | 219/373 X |
| 3,981,314 | 9/1976 | Barradas | 132/9 |
| 3,990,460 | 11/1976 | Shalvoy | 132/9 |
| 4,173,231 | 11/1979 | Isino et al. | 132/9 |
| 4,198,556 | 4/1980 | Crowley et al. | 219/373 X |
| 4,328,818 | 5/1982 | Glucksman | 219/370 X |
| 4,658,116 | 4/1987 | Tsang et al. | 219/364 X |

FOREIGN PATENT DOCUMENTS

| | | | |
|---|---|---|---|
| 511589 | 10/1930 | Fed. Rep. of Germany | 219/370 |
| 2618816 | 3/1978 | Fed. Rep. of Germany | 219/370 |
| 2422358 | 12/1979 | France | 132/11 R |
| 272949 | 4/1951 | Switzerland | 132/112 |
| 466897 | 2/1969 | Switzerland | 34/96 |

*Primary Examiner*—E. A. Goldberg
*Assistant Examiner*—M. M. Lateef
*Attorney, Agent, or Firm*—Laff, Whitesel, Conte & Saret

[57] ABSTRACT

An electric hair dryer having an outer housing with a dependent pistol grip handle extending in one direction. An attachment extends from the opposite side of the housing at an obtuse angle of preferrably 133° with respect to the handle. One attachment comprises an arcuate air duct having a two spaced parallel longitudinal and one transverse air discharge vent directed to cause air streams to collide and blow out in front of the dryer. Another attachment comprising a slightly arcuate brush attachment also having two parallel longitudinal air ducts and one transverse air duct and a plurality of bristles on the concave side, still another attachment comprising a slightly arcuate comb attachment having a wind tunnel at the back with two parallel rows of equally spaced, divergent teeth extending away from the concave side of the arcuate comb.

18 Claims, 3 Drawing Sheets

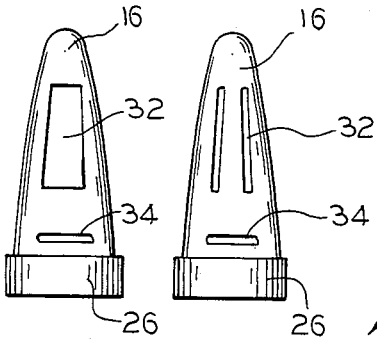
FIG.3B FIG.3A
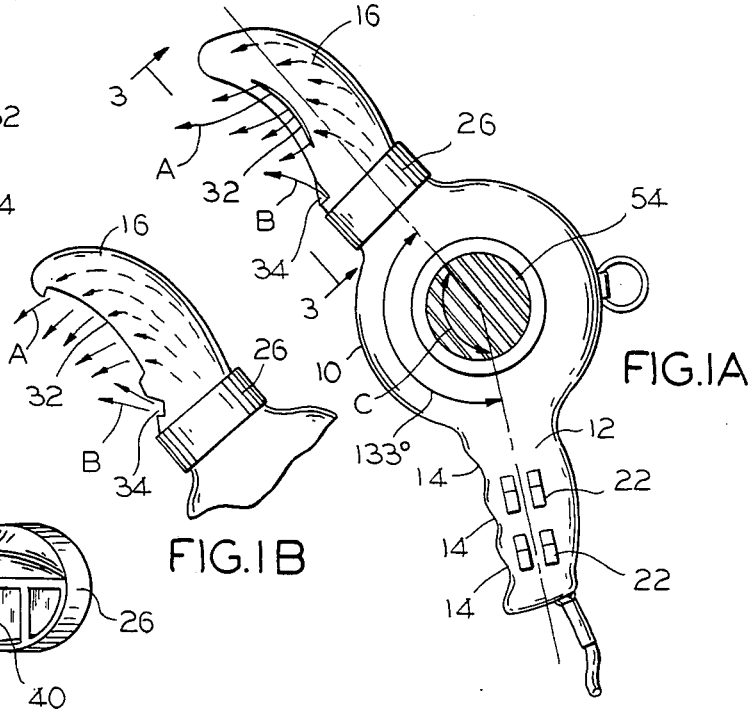
FIG.1A
FIG.1B
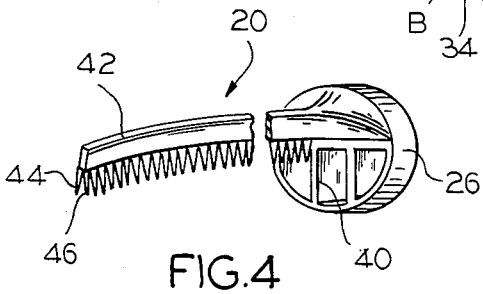
FIG.4
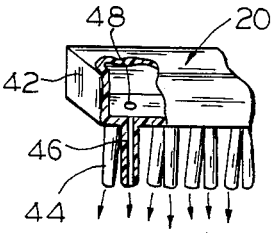
FIG.5
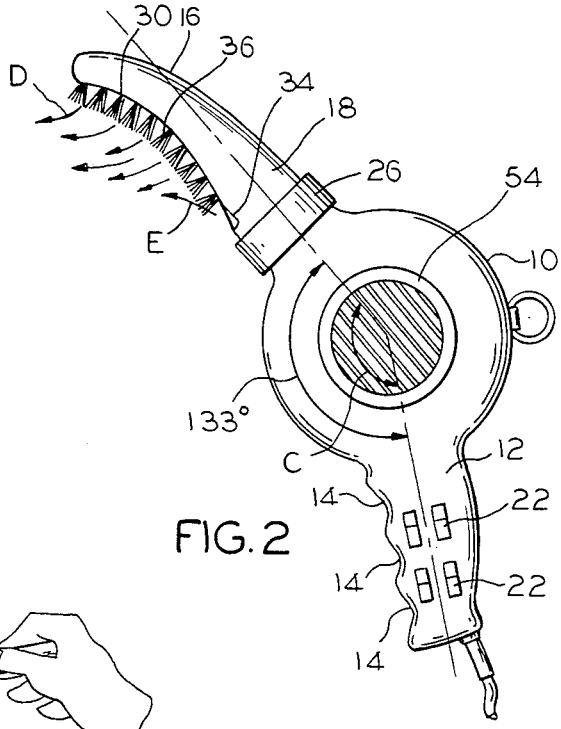
FIG.2
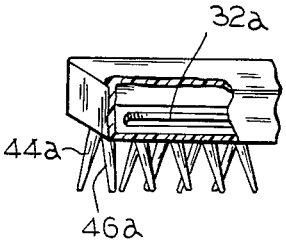
FIG.6
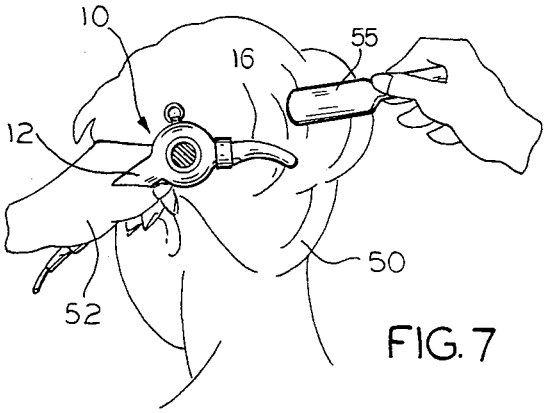
FIG.7

HAND HELD HAIR DRYER

This is a continuation-in-part of Ser. No. 06/714,169, filed Mar. 20, 1985.

This invention relates to an apparatus for emitting streams of air, and more particularly to hand held hair dryers, especially for professional use.

In the field of hand-held hair dryers, there are three common types which include the pistol grip dryer, the styler-dryer, and an axial flow dryer. The pistol grip dryer has a pistol type handle, a centrifugal fan, and an air discharge nozzle projecting at a right angle relative to the handle. Generally, a cylindrical style-dryer or vane-axial type dryer has vanes positioned parallel to the axis of blower rotation. An adjacent discharge duct has a length and width which are about the same as the length and width of the blower. A handle is also parallel to the blower axis. The axial flow dryer has a generally straight tubular shape, wherein one end serves as a handle. The opposite end serves as a discharge duct. A fan is situated in the tube near its mid-point for forcing air, entering at side vents to flow through the tube and to exit its discharge end.

Professional hair stylists frequently use the pistol grip type of blow dryer which has a gun barrel type discharge duct for providing a directed air flow as the stylist points the air duct toward the customer's hair. A problem with the pistol grip type of hair dryer is that the 90° angle between the grip and the air duct makes it awkward for a stylist to dry another person's hair. For example, it is uncomfortable for the stylist to hold the blower in certain positions such as when drying the top or the side of the head unless the stylist is facing the side, which may make it awkward to look at and beyond the customer's face and toward the back of the head.

These three types of dryers also require the stylist using the dryer to use two hands, one to style the hair with a brush or comb and the other to hold the blow dryer. This has to be done while the stylist is looking in the correct direction to see the effect of the styling that is being prepared. Most of the time, there has to be a compromise wherein the efficiency of one of the three (blowing, drying, and looking) is sacrificed to benefit the other.

Accordingly, an object of this invention is to provide a new hair dryer with a structure which is well suited for use by a stylist who is working on another person. In greater detail, an object is to provide a hair dryer which enables a professional stylist to dry another person's hair with freedom from awkward and uncomfortable hand positions. Here an object is to enable the stylist to hold her hands in a natural position while aiming a flow of air at the other person's hair and while combing and brushing. A further object is to provide a hair dryer with brush and comb attachments to enable a stylist to have an unencumbered hand.

In keeping with an aspect of the invention, the inventive dryer has a generally cylindrical outer housing with an elongated handle extending in one direction and an arcuately shaped air discharge nozzle, brush or comb extending at an obtuse angle relative to the handle. The hair dryer has an obtuse angle ranging from 110°-150° (preferrably 133°) between the grip and air apertures positioned along the bottom side of an arcuate nozzle. The invention further provides for special brush or comb attachments which may be fitted on the nozzle or air discharge port so that air flows through the bristles or teeth of the attachment.

A preferred embodiment is illustrated in the drawings wherein:

FIGS. 1A and 1B are side elevations showing the inventive dryer with two air discharge venting systems, in a pistol type configuration with a 133° angle;

FIG. 2 is a side elevation of the new dryer with a styler brush attachment;

FIGS. 3A and 3B are bottom plan views looking up along line 3—3 of FIGS. 1A and 1B, toward air discharge vents;

Figure 8:
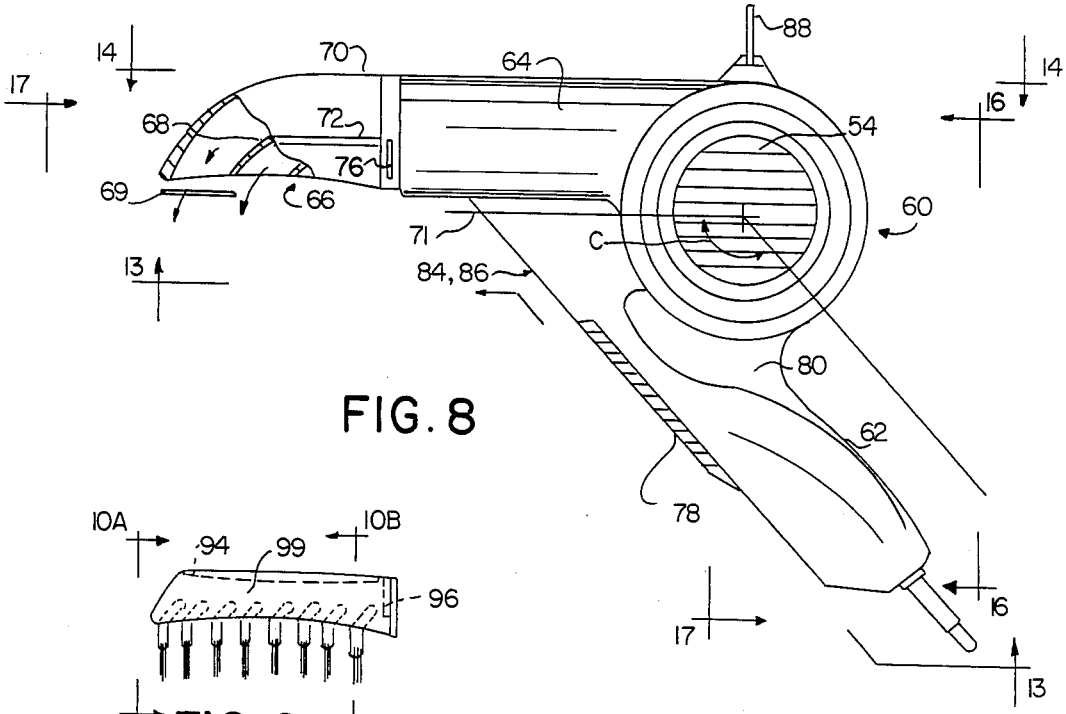
Figure 9:
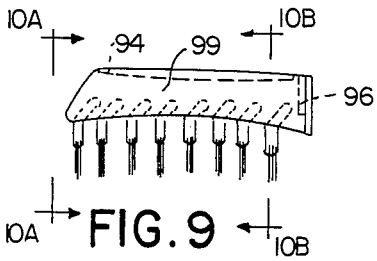
Figure 10A:
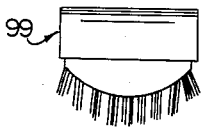
Figure 10B:
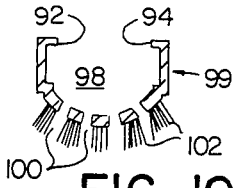
Figure 11:
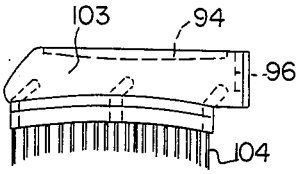
Figure 12:
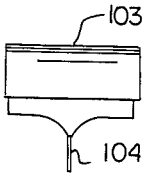
Figure 13:
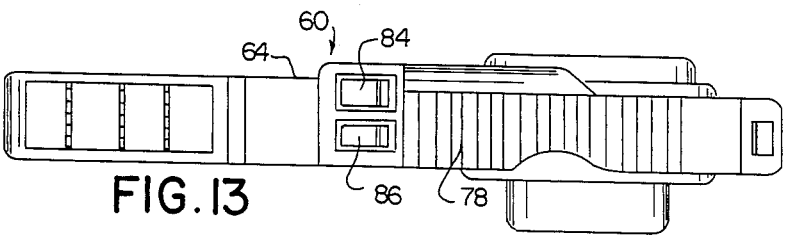
Figure 14:
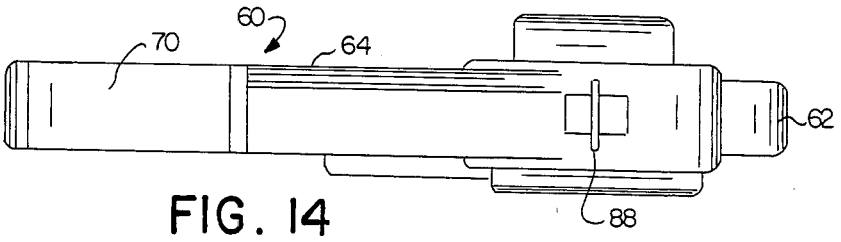

FIG. 4 in perspective shows a view of a comb attachment;

FIG. 5 is a side elevation (partly in cross section) view of a first embodiment of the comb attachment;

FIG. 6 is a similar side elevation view of a second embodiment of the comb attachment;

FIG. 7 illustrates the invention in use;

FIG. 8 is a side elevation of a second embodiment of the inventive hair blower;

FIG. 9 is a side elevation of a snap on brush attachment;

FIG. 10A is a front elevation of the brush taken along line 10A—10A of FIG. 9;

FIG. 10B is a cross section taken along line 10B—10B of FIG. 9;

FIG. 11 is a side elevation of a snap on comb attachment;

FIG. 12 is a front elevation of the comb of FIG. 11;

FIG. 13 is a plan view, taken along line 13—13, showing the bottom of the blower of FIG. 8;

FIG. 14 is a plan view, taken along line 14—14 of FIG. 8, showing the top of the blower.

Figure 15:
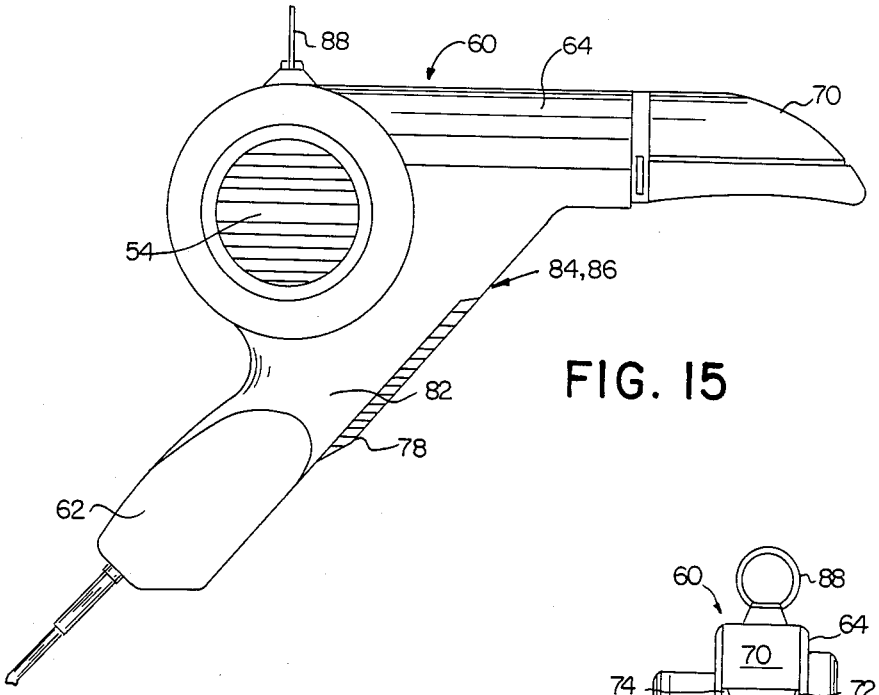
Figure 17:
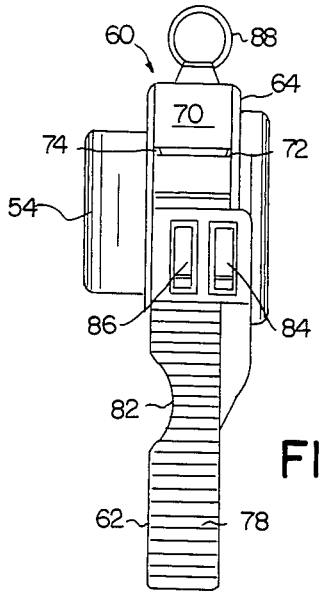
Figure 16:
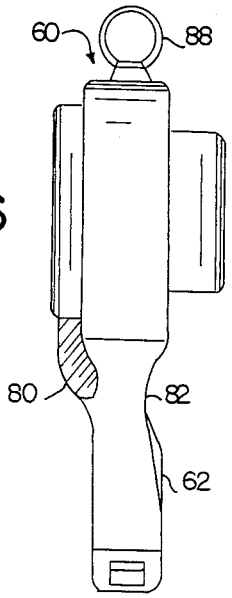

FIG. 15 is an elevation showing the opposite side of the blower, as compared to FIG. 8;

FIG. 16 is a rear elevation, taken along line 16—16 of FIG. 8, of the blower; and FIG. 17 is a front elevation, taken along line 17—17 of FIG. 8, of the blower.

The hand held dryer illustrated in FIGS. 1, 2 comprises an outer housing 10 having a dependent pistol grip handle 12 with fingergrips 14 and an attachment, such as air duct 16, in FIG. 1, brush 18 in FIG. 2, and comb 20 in FIG. 4. The housing accommodates known elements (not shown), such as an electric motor, a fan, and a heating element, which together provide a means for delivering a stream of air. These elements are controlled by means of slide switches or buttons 22 or the like on the handle 12. More particularly, these switches enable a selection between high and low heat, high and low velocity air, off and on, and the like.

Each of the attachments (air duct attachments 16, brush 18, and comb 20) may have any convenient and attachment means 26, such as a simple frictional sleeve connection, a slide-and-turn bayonet connection, or a threaded connection. Each of these attachments when attached to blower housing 10 form an angle C as measured from the handle 12. In a preferred embodiment, the angle C is 133° degrees.

The two versions of air duct 16 are arcuate as seen in side view in FIGS. 1A and 1B and in plan view in FIGS. 3A and 3B. The air stream inside these arcuate ducts, shown by dashed line arrows, is deflected from the top toward the bottom of the duct owing to the curved surfaces. As the air leaves one or more elongated longitudinal slots 32, it is moving in direction A (FIG. 1). However, near the base of the duct 16 is a transverse slot 34, from which air is blowing in direction B. There is some turbulence where these two streams A and B collide. Also, as a result, the air stream is directed outwardly and toward the front of the blower, This way, the air strikes the head at a point which enables a styling comb or brush to be used without mechanical interference from the blower.

When the brush attachment 18 (FIG. 2) is used, the bristles 36 tend to hamper the turbulence of air flow which occurs with the duct 16; therefore, the stream of air from one or more longitudinal slots 32 (represneted by arrows D) tends to be more concentrated at the bristle tips. The air streams from the transverse slot 34 continues to blow in direction E, which tends to toss the hair a bit, as it is being brushed. Thus, there is a more fluffy appearance to the hair than there would be if the bristles simply aligned the hair, pressed it down and set it in place.

The comb 20 is seen in FIGS. 4–6. In the area near the blower housing, there is a wind outlet 40 which is blowing air directly at the comb.

The back of the comb may be a hollow wind tunnel 42 with two sets of slightly divergent teeth depending therefrom. These teeth may be either solid or hollow tubes. More particularly, as best seen in FIG. 5, each tooth in one embodiment is, in effect a hollow tube through which air may pass. By way of example, the tubular nature of tooth 46 is shown in cross-section. The air hole 48 enables air to pass from the wind tunnel 42 and through the tubular tooth 44. In place of or in addition to hollow teeth, there may be a slot **32*a* (FIG. 6), between the two rows of teeth represented by teeth 44*a*, 46*a*. The slot 32*a* is used exclusively when the teeth are solid. The two divergent sets of teeth 44, 46 are slighty spread away from each other so that the scalp is bathed by a wider band of air, when combed by this attachment. In one embodiment, the bottom tips of the teeth were about ¼-inch apart. The tops of the teeth were about 3/32-inch apart, thus giving a divergence of 1/32-inch. Also, the air stream from the outlet 40** tends to give the hair a wind blown look.

In the operation of the inventive device (FIG. 7), the hands of a hair stylist is shown working on the hair 50 of a customer. The stylist may hold the inventive dryer in one hand 52 while she uses hair brush 54 with the other hand. Since the converging air streams A, B (FIG. 1) or D, E (FIG. 2) place air out and in front of the blower 10, the brush 54 may be used without danger of colliding with the blower.

Air is drawn in through air intake vents 54 (FIG. 1) and is forced by the fan through heater coils (not shown) and then through the air discharge port 26 to be expelled through the exhaust duct 16 and slots or apertures 32 and 34 flowing generally as indicated by the arrows A and B in FIG. 1. When the duct 16 is removed and the comb 20 or brush 18 attachments are attached to the housing 10, the air is expelled from apertures adjacent bristles 36 and aperture 34 in the brush attachment 18 in FIG. 2. The air flows as generally indicated by the arrows D and E in FIG. 2. In FIG. 4, the entire air flow is out openings 40 and toward this comb. In the comb attachment 20 (FIGS. 5, 6) air flows between two rows of the teeth of the comb and through the hollow teeth of the comb attachment 20.

A second embodiment 60 of the inventive hair blower is shown in FIGS. 8–17. The pistol grip handle 62 is offset from the axis of the blower housing 64 by the same angle C that appears in FIG. 1A, in the general range of 110°–150°, and more particularly approximately 133°. The blower air is taken in via vents 54 at an entrance end of housing 64, heated inside the housing by means not shown, and blown out the exit end 66 of housing 64. Inside the end 66, the housing 64 contains one or more guides, such as 68, which direct an out going stream of air 69 onto the head of the person whose hair is being dried.

On the nose end 70 of the housing 64, there is a pair of spaced parallel grooves 72, 74 (FIG. 17) for receiving and supporting an attachment. A vertical rib or groove member 76 (FIG. 8) provides a locking ridge or groove over which an attachment sliding in grooves 72, 74 snaps.

A preferably resilient material 78, such as foam rubber 78, for example, is provided on the handle 62 for the fingers to grip. A groove 80 is formed on one side of the pistol grip to receive the thumb and an opposing groove 82 is formed on the opposite side of the pistol grip to receive a finger of the person who is holding the blower. A pair of switches 84, 86 are positioned on the grip to control air temperature and to switch the blower motor on and off.

A hanger ring 88 is attached to the top of the housing and over its center of gravity so that the blower may be hung up when not in use.

The nose housing 70 may be designed either to snap on or off or to be an integral part of the blower housing 64. Either way, it provides grooves 72 and 74 for slidingly receiving the opposing, inwardly turned edges 92, 94 (FIG. 10B) on the attachments of FIGS. 9–11. Each attachment for the hair dryer has similar inwardly directed, opposing edges 92, 94 (FIG. 10B). At 96 (FIGS. 9, 11), each attachment has a shape which is complementary to the shape of the rib or groove 76 (FIG. 8) so that the attachment snaps over and locks thereto.

The brush attachment 99 includes in air chamber 98 (FIG. 10B) having perforations (such as 100) in the bottom thereof. Tufts of bristles (such as 102) are secured to the bottom of the air chamber and between the perforations 100.

FIGS. 11 and 12 show a comb attachment 103 which is constructed in approximately the same manner as the brush 99, except that a comb 104 is provided at the place where the bristles 102 are provided on brush 99.

Those who are skilled in the art will readily perceive how to modify the invention. Therefore, the appended claims are to be construed to cover all equivalent structures which fall within the true scope and spirit of the invention.

The claimed invention is:

1. A hand held hair dryer in the form of a handgun including an outer housing n the barrel position of said handgun which accommodates means for producing and for delivering a stream of heated air, an elongated handle located on one end of and dependent from said housing, said housing having an air outlet comprising connection means mounting an elongated removable attachment on approximately the opposite end of the housing, said removable attachment having a longitudinal axis and extending from said housing at an obtuse angle with respect to the longitudinal axis of said handle, air discharge openings on said attachment for directing air therefrom in a direction which is substantially transverse to the longitudinal axis of said removable attachment, said attachment having at least one air discharge vent arranged to direct a portion of discharge air in a direction along the longitudinal axis of the attachment so that the air streams discharged from said attachment collide and blow the air out and in front of the dryer.

2. The dryer of claim 1 wherein said handle includes control means for selecting between several heat and air velocity settings.

3. A hand held hair dryer including an outer housing which accommodates means for producing and for delivering a stream of heated air, an elongated handle located on one end of and dependent from said housing, said housing having an air outlet comprising connection means mounting an elongated removable attachment on approximately the opposite end of the housing, said removable attachment having a longitudinal axis and extending from said housing at an obtuse angle with respect to the longitudinal axis of said handle, air discharge openings on said attachment for directing air therefrom in a direction which is substantially transverse to the longitudinal axis of said removable attachment, said attachment having at least one transverse air discharge vent arranged to direct a portion of discharged air in a direction along the longitudinal axis of the attachment and directed so that the air streams discharged from said attachment collide and blow the air out and in front of the dryer, and further wherein said removable attachment is arcuate and there are two of said longitudinal vents in a spaced parallel relationship on the concave side of said arcuate attachment, and said at least one transverse vent being near said connection means and being directed to blow into air emerging from said longitudinal vents to cause said collision.

4. The dryer of claim 1 wherein said removable attachment is arcuate and said attachment has a plurality of bristles dependent therefrom on said concave side and adjacent at least one said longitudinal vent.

5. The dryer of claim 1 wherein said removable attachment is arcuate and two sets of teeth extend from the concave side of said arcuate attachment, said air flowing from at least one longitudinal vent between said sets of teeth.

6. The dryer of claim 5 wherein said teeth are hollow tubes for delivering the air directly onto the scalp of a user.

7. The dryer of claim 1 wherein said obtuse angle is substantially 133°.

8. A hand held dryer in the form of a hand gun including and an outer housing in the position of a barrel on a hand gun having an elongated handle dependent from one end and an air discharge port at the other end of said barrel and having connecting means the other end, removable attachment means connected to said connecting means of said air discharge port, means in said housing for producing and delivering a stream of heated air to said discharge port at the other end of said barrel, said attachment means when mounted on said housing forming an obtuse angle taken with respect to a longitudinal axis of said handle, said obtuse angle being in the range from 110° to 150°, and means including said removable attachment means for discharging air in a direction which is transverse and at an acute angle relative to the dependent handle.

9. A hand held dryer including and an outer housing having an elongated handle dependent from one end and an air discharge port having connecting means extending from the other end, removable attachment means connected to said connecting means of said air discharge port, means in said housing for producing and delivering a stream of heated air to said discharge port, said attachment means when mounted on said housing forming an obtuse angle taken with respect to a longitudinal axis of said handle, said obtuse angle being in the range from 110° to 150°, and means including said removable attachment means for discharging air in a direction which is transverse to one side of said obtuse angle, wherein said attachment means comprises an elongated arcuate nozzle with a closed end, a base for connecting the opposite end of said arcuate nozzle to said air discharge port connecting means and apertures on the concave side of said nozzle for giving air dispersement, said apertures comprising two spaced parallel longitudinal apertures from which air flows transversely with respect to the longitudinal axis of the nozzle and one transverse aperture at the base of the nozzle from which air flows out longitudinally along the inside of the arc and into collision with air flowing out said longitudinal apertures.

10. The hair dryer of claim 8 wherein said removable attachment means comprises a slightly arcuate elongated brush with bristles extend transversely therefrom, said bristles being arranged in equally spaced rows along the concave surface of the removable attachment means, and apertures located adjacent the bristles of the brush for enabling air to flow from the air discharge port through said apertures.

11. The hair dryer of claim 8 wherein said removable attachment means comprises an arcuate comb having a wind tunnel at the back with two parallel rows of equally spaced teeth extending away from said back of the concave side of the arcuate comb, an aperture running along the length of said comb and between said teeth whereby air flowing from the air discharge port flows out through the wind tunnel and out the aperture between said teeth.

12. A hair dryer comprising an elongated housing having an air entrance at one end and an exit at the opposite end with an air chamber extending therebetween, means for heating the air passing through said housing, a pistol grip handle extending away from said housing at an obtuse angle in the range of substantially 110°-150° with respect to the elongated axis of the blower housing, and a nose piece on the exit end of said housing for guiding and directing an outgoing air stream at an obtuse angle in the range of approximately 110°-150° with respect to the elongated axis of said housing.

13. The hair dryer of claim 12 wherein the angle between the handle and the housing is substantially 133°.

14. The hair dryer of claim 12 and spaced parallel, longitudinal grooves formed on opposite sides of said nose piece, at least one attachment, said attachment having spaced parallel inwardly directed opposing edges for sliding onto said longitudinal grooves, an air chamber in said attachment, said air chamber being secured to said nose piece to receive said outgoing air stream, and air holes adjacent a working surface of said air chamber for providing an outward flow of air from said air chamber.

15. The hair dryer of claim 14 and locking means adjacent said longitudinal grooves and opposing edges for locking said attachment to said nose piece.

16. The hair dryer of claim 15 wherein said attachment is a brush.

17. The hair dryer of claim 15 wherein said attachment is a comb.

18. The hair dryer of claim 12 and soft flexible means covering the part of said pistol grip handle which the fingers engage.

* * * * *